United States Patent [19]

Harris et al.

[11] 4,291,071

[45] Sep. 22, 1981

[54] WASHING AND SOFTENING COMPOSITIONS

[75] Inventors: Richard G. Harris, Mitford; Allan C. McRitchie, Tyne & Wear; Alexander D. Wilson, Newcastle upon Tyne, all of England

[73] Assignee: The Procter & Gamble Company, Cincinnati, Ohio

[21] Appl. No.: 49,677

[22] Filed: Jun. 18, 1979

[30] Foreign Application Priority Data

Jun. 20, 1978 [GB] United Kingdom ..... 27380/78

[51] Int. Cl.[3] ..... C11D 1/86; C11D 11/00; C11D 17/06; D06M 13/46

[52] U.S. Cl. ..... 427/220; 252/8.75; 252/8.8; 252/91; 252/110; 252/174; 252/174.13; 252/174.21; 252/528; 252/547

[58] Field of Search ..... 252/8.75, 8.8, 174.21, 252/528, 547, 110, 91, 174.13; 427/220

[56] References Cited

U.S. PATENT DOCUMENTS

| | | | |
|---|---|---|---|
| 3,360,470 | 12/1967 | Wixon | 252/99 |
| 3,591,405 | 7/1971 | McCarty | 252/543 X |
| 3,607,763 | 9/1971 | Salmen | 252/547 |
| 3,799,880 | 3/1974 | Kelly | 252/110 |
| 3,886,098 | 5/1975 | Di Salvo | 252/540 |
| 3,936,537 | 2/1976 | Baskerville | 427/242 |
| 4,072,621 | 2/1978 | Rose | 252/140 |
| 4,141,841 | 2/1979 | McDanald | 252/8.8 |
| 4,179,391 | 12/1979 | Kaufman | 252/99 |

FOREIGN PATENT DOCUMENTS

| | | | |
|---|---|---|---|
| 1252298 | 11/1971 | United Kingdom . | |
| 1314381 | 4/1973 | United Kingdom . | |
| 1392284 | 4/1975 | United Kingdom . | |
| 1459034 | 12/1976 | United Kingdom . | |
| 1535786 | 12/1978 | United Kingdom | 252/110 |

*Primary Examiner*—Dennis L. Albrecht

[57] ABSTRACT

Textile softening detergent compositions comprise a nonionic detergent, a cationic textile softener, a builder and a water-soluble polyphosphonic acid of the formula

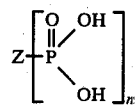

wherein n is 2 or more and Z is an organic group of effective covalency n, or a water-soluble salt thereof, and are preferably made by spray drying a mixture of the nonionic detergent and cationic softener on to spray dried carrier granules comprising at least part of the builders.

1 Claim, No Drawings

WASHING AND SOFTENING COMPOSITIONS

FIELD OF THE INVENTION

The present invention relates to granular built detergent compositions which have very good cleaning properties and also textile softening properties.

BACKGROUND OF THE INVENTION

For many years, most heavy duty, built, detergent compositions have been based upon anionic surfactants and they have been observed to cause some harshness in the feel of washed fabrics. Accordingly, there have been developed textile softening compositions, and these have been based upon long chain cationic surfactants. As cationic and anionic surfactants are generally incompatible, these softening compositions have been intended for use in the final rinse of a washing process, that is after substantially all the anionic surfactant has been removed. Clearly there is a need for a single composition able both to clean the fabrics and to soften them.

Attempts to incorporate cationic softeners in anionic based detergent compositions, overcoming their ordinary incompatibility, have been described in the art. Another approach has been to use nonionic surfactants with cationic softeners in built detergent compositions as described in Brit. Pat. No. 1,079,388, DTAS No. 1,220,956 and U.S. Pat. No. 3,607,763. However, products containing a high ratio of nonionic detergent to cationic softener are said to soften inadequately, whereas those with a high ratio of cationic to nonionic are said to clean inadequately. A particular problem in the use of such products has been the discolouration, usually yellowing, of repeatedly washed fabrics.

This problem is believed to arise from three causes. The first is the ineffectiveness of most of the usual optical brighteners when applied in the presence of cationic surfactants, due to the failure of the brightener to deposit upon fabrics in such surroundings and/or from an actual quenching of the fluorescence of the brightener in the presence of cationic surfactant. The second main cause of yellowing is build-up of the brightener itself, which in some circumstances can act as a dyestuff at visible wavelengths. The third cause is apparently an interaction between the cationic or nonionic-cationic surfactants and colouring matter in the water used to make up the wash baths. The extent of this problem depends upon the state of the civic water supply, and can vary from place to place and from time to time. Iron content may be one relevant factor, but probably organic, e.g. peaty colouring matter, is more usually the principal cause. Although exact mechanism is not known, it seems that the presence of the cationic softener component tends to aggravate the deposition of this and other solid suspended matter upon the washed fabrics, and to inhibit the removal of certain normally bleachable stains. The deposition of suspended matter can be reduced and the removal of bleachable stains improved, according to the present invention, by the inclusion of small amounts of a class of organic phosphonates in the composition.

Anionic based detergent compositions containing ethylene diamine tetra methylene phosphonate as a stabiliser for persalts are disclosed in British Pat. No. 1,392,284. Compositions containing anionic, amphoteric or nonionic surfactant, preferably at least half being anionic; a fabric softener comprising a specified condensation product of fatty glyceride and a hydroxyalkyl polyamine and optionally a di-long chain alkyl quaternary ammonium salt; and a foam inhibitor; are described in British Pat. No. 1,314,381. These compositions may contain a sequestering agent such as ethylene diamine tetra acetate, hydroxy ethane-1,1-diphosphonate or nitrilotrimethylene phosphonate.

SUMMARY OF THE INVENTION

According to the invention, there is provided a detergent composition which imparts a soft feel to fabrics washed therewith, which comprises:

(a) from 3% to 30% of one or more polyethoxy nonionic surfactants having hydrophilic-lipophilic balance in the range from 8 to 15 and having not more than an average of 16 ethoxy units per molecule;

(b) from 1% to 15% of one or more cationic textile softeners;

(c) from 10% to 80% of one or more detergency builders; and (d) from 0.1 to 5% of a water-soluble polyphosphonic acid having the general formula:

$$Z[PO(OH)_2]_n$$

or a water-soluble salt thereof, wherein n is at least 2 and Z is a connecting organic moiety having an effective covalency equal to n.

With respect to the product aspect of the present invention, the presence of anionic surfactants is unnecessary. Preferably, any anionic surfactant is present only in minor amounts, for example in a weight ratio of anionic surfactant to cationic softener of less than 1:5.

In a preferred process aspect of the invention, components (a) and (b) are sprayed on to a moving bed formed of spray dried granules composed of components (d) and at least part of (c). In this preferred process, a low level of anionic surfactant is conveniently incorporated in the spray dried carrier granules to aid in density control.

DETAILED DESCRIPTION OF THE INVENTION

The Nonionic Detergent

Water-soluble nonionic ethoxylates constitute the principal surfactant component of the present compositions. Such surfactants can be broadly defined as compounds produced by the condensation of ethylene oxide groups (hydrophilic in nature) with an organic hydrophobic (lipophilic) compound, which may be aliphatic or alkyl aromatic in nature. The number of ethylene oxide groups condensed with any particular hydrophobic group is adjusted to yield a water-soluble compound having a hydrophilic-lipophilic balance (HLB) of between about 8 and about 15.

Examples of suitable nonionic detergents include: 1. The polyethylene oxide condensates of alkyl phenol, e.g. the condensation products of alkyl phenols having an alkyl group containing from 6 to 12 carbon atoms in either a straight chain or branched chain configuration, with ethylene oxide, the said ethylene oxide being present in amounts equal to 5 to 16 moles of ethylene oxide per mole of alkyl phenol. The alkyl substituent in such compounds may be derived, for example, from polymerised propylene, di-isobutylene, octene or nonene. Other examples include dodecylphenol condensed with 12 moles of ethylene oxide per mole of phenol; dinonylphenol condensed with 15 moles of ethylene oxide per mole of phenol; nonylphenol condensed with 9 moles of ethylene oxide per mole of nonylphenol and di-iso-octylphenol condensed with 15 moles of ethylene oxide. 2. The condensation product of primary or secondary aliphatic alcohols having from 8 to 20 carbon atoms, in either straight chain or branched chain configuration, with from 1 to about 16 moles of ethylene oxide per mole of alcohol. Preferably, the aliphatic alcohol comprises between 9 and 15 carbon atoms and is ethoxylated with between 2 and 12, desirably between 3 and 8 moles of ethylene oxide per mole of aliphatic alcohol. Such nonionic surfactants are preferred from the point of view of providing good to excellent detergency performance on fatty and greasy soils. The preferred surfactants are prepared from primary alcohols which are either linear (such as those derived from natural fats or prepared by the Ziegler process from ethylene, e.g. myristyl, cetyl, stearyl alcohols), or partly branched such as the Dobanols and Neodols which have about 25% 2-methyl branching (Dobanol and Neodol being Trade Names of Shell) or Synperonics, which are understood to have about 50% 2-methyl branching (Synperonic is a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-11, Dobanol 91-3, Dobanol 91-6, Dobanol 91-8, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 20 carbon atoms. Secondary linear alkyl ethoxylates are also suitable in the present composition, especially those ethoxylates of the Tergitol series having from about 9 to 16 carbon atoms in the alkyl group and up to about 11, especially from about 3 to 9, ethoxy residues per molecule. 3. The compounds formed by condensing ethylene oxide with a hydrophobic base formed by the condensation of propylene oxide with propylene glycol. The molecular weight of the hydrophobic portion generally falls in the range of about 1500 to 1800. Such synthetic nonionic detergents are available on the market under the Trade Name of "Pluronic" supplied by Wyandotte Chemicals Corporation.

Preferred nonionic detergents are coconut alcohols with 6 ethoxy residues per molecule, and Dobanol 45-7 (Trade Name for $C_{14-15}$ primary alcohols with 7 ethoxy residues per molecule).

The nonionic detergent comprises from 3% to 30%, preferably from 5% to 19% by weight of the composition.

The Cationic Softener

Any cationic softener may be used in the compositions of the invention.

Among suitable cationic softeners are the conventional substantially water-insoluble quaternary ammonium compounds, and $C_{8-25}$ alkyl imidazolinium salts.

Well known species of substantially water-insoluble quaternary ammonium compounds have the formula:

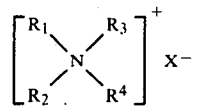

wherein $R_1$ and $R_2$ represent hydrocarbyl groups of from about 10 to about 22 carbon atoms; $R_3$ and $R_4$ represent hydrocarbyl groups containing from 1 to about 4 carbon atoms, X is any anion such as halide, a $C_{2-4}$ carboxylate, or an alkyl or arylsulf(on)ate. Examples of preferred anions include bromide, chloride; methyl sulfate, toluene-, xylene-, cumene-, and benzene sulfonate benzoate, parahydroxybenzoate, acetate and propionate. Representative examples of quaternary softeners include ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl ammonium chloride; di(hydrogenated tallow) dimethyl ammonium methyl sulfate; dihexadecyl diethyl ammonium chloride; di(coconutalkyl) dimethyl ammonium chloride. Ditallow dimethyl ammonium chloride, di(hydrogenated tallow-alkyl) dimethyl ammonium chloride and di-(coconutalkyl) dimethyl ammonium chloride are preferred. Also suitable are the single long chained quaternary ammonium compounds of the above formula wherein $R_1$ is $C_{10}$ to $C_{22}$ alkyl or alkenyl, preferably $C_{10}$ to $C_{20}$ alkyl, and $R_2$ $R_3$ and $R_4$ are lower alkyl groups that is $C_1$ to $C_4$ alkyl groups especially methyl, or aryl groups and X is as defined above. Optionally also two or all three of $R_2$, $R_3$ and $R_4$ may together represent a heterocyclic ring. Some representative examples of such compounds are lauryl trimethyl ammonium bromide, lauryl dimethyl benzyl ammonium chloride, myristyl dimethyl ethyl ammonium bromide, cetyl trimethyl ammonium bromide, behenyl trimethyl ammonium methosulfate oleyl methyl diethyl ammonium chloride, cetyl stearyl or oleyl pyridinium chloride, behenyl pyridinium bromide, stearyl methyl morpholinium chloride, stearyl or oleyl ethyl or propyl morpholinium chloride.

Yet other quaternary ammonium cationic surfactants which may be mentioned have the formula:

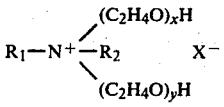

wherein $R_1$ and $R_2$ are as defined above or $R_2$ may be hydrogen and x and y are at least 1 and (x+y) is from 2 to 25.

Examples are:

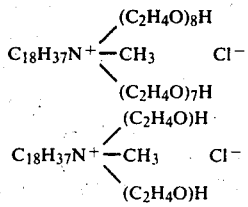

-continued

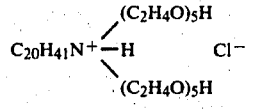

Substances of this sort are sold commercially, for instance, under the Trade Name "Ethoquads".

Another class of suitable cationic surfactants can be represented by $C_{8-25}$ alkylimidazolinium salts. Preferred salts are those conforming to the formula:

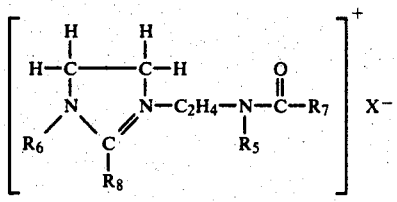

wherein $R_6$ is a $C_{1-4}$ alkyl radical, $R_5$ is hydrogen or a $C_{1-4}$ alkyl radical, $R_8$ is a $C_{8-25}$ radical, and $R_7$ is hydrogen or a $C_{8-25}$ alkyl radical. X is a charge balancing ion which has the same meaning as X defined in the quaternary ammonium surfactant above.

A preferred member of this class, believed to have $R_6$=methyl, $R_7$ and $R_8$=tallow alkyl, $R_5$=hydrogen, is sold under the Trade Name Varisoft 455 or 475 (Ashland Chemical Company), or Steinaquat M 5040/H (Messrs Chemische Werke Rewo).

Among other suitable cationic surfactants may be mentioned the substituted polyamine salts of general formula

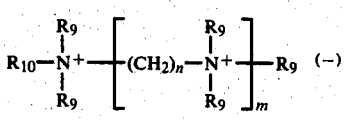

wherein $R_{10}$ is an alkyl or alkenyl group having from about 10 to 24, preferably 12 to 20, especially from 16 to 18 carbon atoms, the groups $R_9$ which may be the same or different, each represent hydrogen, a $(C_2H_4O)_pH$, or a $(C_3H_6O)_qH$, or a $C_{1-3}$ alkyl group where p and q may each be O or a number such that (p+q) does not exceed 25, n is an integer from 2 to 6, preferably 3, m is from about 1 to 9, preferably from 1 to 4, most preferably 1 or 2, and $X^{(-)}$ represents one or more anions having total charge balancing that of the nitrogen atoms.

Suitable compounds of this class are, N-tallow-N, N', N'-trimethyl-1, 3-propylene diamine dihydrochloride or di-hydrogen methosulphate, commercially available under the Trade Names Lilamin 540 EO-3 (Lilachem), Dinoramax SH3, Inopol ODX3 (Pierrefitte-Auby); and N-tallow-N,N,N',N',N'-pentamethyl-1, 3-propylene diamine dichloride, commercially available under the Trade Names Stabirin MS-3 (Pierrefitte-Auby); Duoquad (Armour Hess); Adogen 477 (Ashland Company). Also suitable is the substance sold as Dinormac (Pierrefitte-Auby) or Duomac (Armour Hess) believed to have the formula:

$$\text{Tallowyl—}N^+H_2\text{—}(CH_3)_3\text{—}N^+H_3,\ 2(OCOCH_3)^-$$

or the corresponding chloride. Herein Tallowyl represents predominantly $C_{16}$ and $C_{18}$ alkyl groups derived from tallow fatty acids.

It is highly desirable when one or more of $R_9$ in these components is hydrogen, that the pH of the formulation be such that one or more of the nitrogen atoms is protonated.

Other suitable cationic softeners are described in French Patent Application No. 2393100, published Dec. 29, 1978 and Davis U.S. Pat. No. 4,076,632, issued Feb. 28, 1978 and incorporated here by reference. Some suitable commercially available substances are marketed under the following Trade Names:

Sopa (Pierrefitte-Auby)
Sopapa
Lilamin LS33 (Lilachim)
Polyram L 200 (Pierrefitte-Auby)
Taflon-320A (Diichi Kogyo Seiyaku Co).

Mixtures of two or more of these cationic softeners may be employed.

Preferred cationic softeners are ditallowyl dimethyl ammonium halides or methosulphate, and imidazolinium salts e.g. Varisoft 455 or 475.

The compositions of the invention contain from 1% to 15% preferably from 3% to 10% by weight of cationic softening agent. It is preferred that the weight ratio of nonionic detergent to cationic softening agent be in the range from 10:1 to 0.5:1 especially from 3:1 to 1:1.

The Detergency Builders

Suitable detergent builder salts useful herein can be of the polyvalent inorganic and polyvalent organic types, or mixture thereof. Non-limiting examples of suitable water-soluble, inorganic alkaline detergent builder salts include the alkali metal carbonates, borates, phosphates, polyphosphates, tripolyphosphates, bicarbonates, silicates, and sulfates. Specific examples of such salts include the sodium and potassium tetraborates, bicarbonates, carbonates, tripolyphosphates, pyrophosphates, pentapolyphosphates and hexametaphosphates.

Examples of suitable organic alkaline detergency builder salts are:

(1) water-soluble amino polyacetates, e.g., sodium and potassium ethylenediamine tetraacetates, nitrilotriacetates, N-(2-hydroxyethyl) nitrilodiacetates and diethylenetriamine pentaacetates;

(2) water-soluble salts of phytic acid, e.g. sodium and potassium phytates;

(3) water-soluble polycarboxylates such as the salts of lactic acid, succinic acid, malonic acid, maleic acid, citric acid, carboxymethylsuccinic acid, 2-oxa-1,1,3-propane tricarboxylic acid, 1,1,2,2-ethane tetracarboxylic acid, cyclopentane-cis, cis, cis-tetracarboxylic acid, mellitic acid and pyromellitic acid.

Mixtures of organic and/or inorganic builders can be used herein.

Another type of detergency builder material useful in the present compositions and processes comprises a water-soluble material capable of forming a water-insoluble reaction product with water hardness cations preferably in combination with a crystallization seed which is capable of providing growth sites for said reactions product. Such "seeded builder" compositions are fully disclosed in British Pat. No. 1,424,406.

Preferred water soluble builders are sodium tripolyphosphate and sodium silicate, and usually both are present. In particular, it is preferred that a substantial proportion, for instance from 3 to 15% by weight of the composition of sodium silicate (solids) of ratio (weight ratio $SiO_2$:$Na_2O$) from 1:1 to 3.5:1 be employed.

A further class of detergency builder materials useful in the present invention are insoluble sodium aluminosilicates, patricularly those described in Belgian Pat. No. 814,874, issued Nov. 12, 1974, incorporated herein by reference. This patent discloses and claims detergent compositions containing sodium aluminosilicates of the formula $$Na_z(AlO_2)_z(SiO)_y xH_2O.$$

wherein z and y are integers equal to at least 6, the molar ratio of z to y is in the range of from 1.0:1 to about 0.5:1, and x is an integer from about 15 to about 264, said aluminosilicates having a calcium ion exchange capacity of at least 200 mg.eq./gram and a calcium ion exchange rate of at least about 2 grains/minute gram. A preferred material is $Na_{12}(SiO_2AlO_2)_{12}27H_2O$.

The compositions contain from 10% to 80%, preferably from 20% to 70% of said builders.

The Organic Phosphonates

The essential organic phosphonates present according to the invention, are those of the general formula:

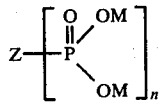

where n is at least 2, M is an alkali metal, ammonium or substituted ammonium cation and Z is a connecting organic moiety having an effective covalency equal to n. Preferably, Z is a hydrocarbyl substituted amino radical. Various specific classes of polyphosphonates useful in the present invention, are indicated below.

The polyphosphonate can be derived from acids selected from the group consisting of those of the formulae:

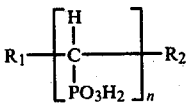

(i)

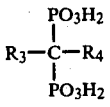

(ii)

wherein $R_1$ and $R_2$ are hydrogen or $CH_2OH$; n is an integer of from 3 to 10; $R_3$ is hydrogen, alkyl containing from 1 to about 20 carbon atoms, alkenyl containing from 2 to about 20 carbon atoms, aryl (e.g. phenyl and naphthyl), phenylethenyl, benzyl, halogen (e.g. chlorine, bromine, and fluorine), amino, substituted amine (e.g. dimethylamino, diethylamino, N-hydroxy-N-ethylamino, acetylamino), $—CH_2COOH$, $—CH_2PO_3H_2$, $—CH(PO_3H_2)(OH)$ or $—CH_2CH(PO_3H_2)_2$; and $R_4$ is hydrogen, lower alkyl (e.g. chlorine, bromine and fluorine), hydroxyl, $—CH_2COOH$, $—CH_2PO_3H_2$, or $—CH_2CH_2PO_3H_2$.

Operable polyphosphonates of the above formula (i) include propane-1,2,3-triphosphonic acid; butane-1,2,3,4-tetraphosphonic acid, hexane-1-hydroxy-2,3,4,5,6-pentaphosphonic acid; and the salts of these acids, e.g. sodium, potassium, calcium, magnesium, ammonium, triethanolammonium, diethanolammonium, and monoethanolammonium salts.

Among the operable polyphosphonates encompassed by the above formula (ii) are ethane-1-hydroxy-1,1-diphosphonic acid; methanediphosphonic acid; methanehydroxydiphosphonic acid; ethane-1,1,2-triphosphonic acid; propane-1,1,3,3-tetraphosphonic acid; ethane-2-phenyl-1,1-diphosphonic acid-ethane-2-naphthyl-1,1-diphosphonic acid; methanephenyldiphosphonic acid; ethane-1-amino-1,1-diphosphonic acid; methanedichlorodiphosphonic acid; propane-2-2-diphosphonic acid; ethane-1-hydroxy-1,1,2-triphosphonic acid; aminomethanediphosphonic acid; and the salts of these acids, e.g., sodium, potassium, calcium, magnesium, ammonium, triethanolammonium, diethanolammonium and monoethanolammonium salts.

Mixtures of any of the foregoing phosphonic acids and/or salts can be used in the compositions of this invention. Methods of preparing these classes of materials are described in U.S. Pat. No. 3,488,419.

For the purposes of this invention, it is preferred that the polyphosphonates are free of hydroxyl groups.

Another useful class of polyphosphonates are the aminotrialkylidene phosphonates; these include acids of the general formula:

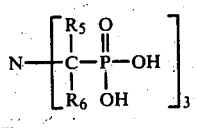

wherein $R_5$ and $R_6$ represent hydrogen or $C_1$–$C_4$ alkyl radicals. Examples of compounds within this general class are aminotri(methylenephosphonic acid), aminotri-(ethylidenephosphonic acid), aminotri-(isopropylidene phosphonic acid), aminodi-(methylenephosphonic acid)mono-(ethylidenephosphonic acid) and aminomono-(methylenephosphonic acid di-(isopropylidenephosphonic acid).

A very highly preferred class of polyphosphonates is that derived from the alkylene-polyaminopolyalkylene phosphonic acids. Especially useful examples of these materials include ethylene diamine tetramethylene phosphonic acid, diethylenetriamine pentamethylene phosphonic acid and hexamethylene diamine tetramethylene phosphonic acid. This class of materials has been found to be outstandingly good at overcoming the fabric yellowing tendencies of compositions based predominantly on nonionic surfactants and cationic softeners. Preferred salts of this class are the alkali metal, especially sodium, salts. The tri or tetra sodium salts of ethylene diamine tetramethylene phosphonate or the tetra or penta sodium salts of diethylene triamine pentamethylene phosphonates are generally those present in the compositions. A mixture of the salts may be employed.

From 0.1% to 5%, preferably from 0.2% to 2% of the phosphonate salt is present by weight of the composition.

Optional Ingredients

Other components useful in conventional built laundry detergents, can additionally be included in the compositions of the present invention.

Sequestering agents, effective especially for chelating ferric iron, may also be present in small amounts, and these can enhance the effect obtained by the presence of the phosphonate salt. These agents include sodium ethylene diamine tetra acetate, sodium diethylene triamine penta acetate, and sodium nitrilo triacetate. A preferred mixture comprises from 0.2% to 2% each of sodium ethylene diamine tetra methylene phosphonate and tetra acetate.

Other ingredients which can offer some reduction in fabric yellowing include:

Relatively high ethoxylates of $C_{10}$–$C_{20}$ monohydric alcohols, i.e. having at least 17 ethoxy groups per molecule on average. Specially preferred are ethoxylated tallow alcohols with from 20 to 100 ethoxy groups, especially 25 or 80. (Conventionally abbreviated as $TAE_{25}$, $TAE_{80}$).

Polyethylene glycols of molecular weight from about 1,000 to 30,000, especially from 6,000 to 20,000 and polyvinyl alcohols of molecular weight from 10,000 to 20,000, preferably about 14,000 and polyoxyethylene sorbitan $C_{12}$–$C_{18}$ fatty acid esters having 17 or more ethylene oxide residues in their constitution.

It is preferred to use from 0.5 to 3.0% of these compounds by weight of the composition.

Soil suspending agents such as sodium carboxymethyl cellulose, preferably at a level from about 0.5 to 1.5% by weight of the compositions.

Methyl vinyl ether—maleic anhydride copolymers or their corresponding acids or salts, e.g. sodium salts, such as are sold for instance by the General Aniline and Film Corporation under the Trade Names Gantrez AN119 and Gantrez S95.

This is a preferred component, at from about 0.5 to 1.5% by weight of the composition.

Furthermore, very low levels (of the order of a few e.g. up to 100 parts per million) of blue or green dyestuffs, such as Polar Brilliant Blue, ultramarine blue, indigo violet, which serve to mask any residual yellowing caused by the compositions of the invention, may be included in the compositions.

Bleaching agents such as sodium perborate, sodium percarbonate and other perhydrates, can be present at levels from about 5% to 35% by weight of the composition, and activators therefor, such as tetra acetyl ethylene diamine, tetra acetyl glycouril and others known in the art, and stabilisers therefor, such as magnesium silicate.

Suds controlling agents are also useful, such as mono or di-ethanolamides of fatty acids as suds stabilisers, and $C_{16-24}$ soaps or fatty acids, silicones, microcrystalline waves and mixtures thereof.

Brighteners, especially nonionic brighteners, are preferably present and particularly the nonionic brighteners described in our copending European Application No. 0006271 as the patent number of the referenced European case.

Other optional ingredients include proteolytic, amylolytic or lipolytic enzymes, colours and perfumes.

Throughout the description herein, where sodium salts have been referred to, potassium, lithium or ammonium, or amine salts may be used instead if their extra cost etc., are justified for special reason.

Making The Compositions

It has been found that it is important, in order to achieve the best possible softening performance from the compositions of the invention, that the cationic softener be finely and intimately dispersed. Thus the cationic softener may be mixed in the form of fine solid particles with the rest of the composition, or it may be included in the crutcher mix which is spray dried to form the granules of the product. The nonionic detergent (and optionally the discolouration inhibitor) may also be included in the crutcher mix. However, it is much preferred to make carrier granules by spray drying a crutcher mix containing at least part, and usually substantially all, of the detergency builders, and the other non-heat sensitive components. In order to obtain carrier granules of desired density, it is usually desirable to include a low level of anionic surfactant, especially sodium $C_{9-16}$ alkyl benzene sulphonate, in the carrier granules, as described in German Offenlegungschrift No. 2,617,956. However, the amount of anionic surfactant should be less than the amount of nonionic surfactant in the compositions, and is usually from 0.1 to 5.0% by weight of the compositions, especially about 0.2 to 1.5%.

A moving bed of the carrier granules, in any suitable mixing equipment such as a pin granulator, a rotating drum or a fluidised bed, is sprayed with a fluid mixture comprising the nonionic detergent and the cationic softener, usually melted together, and generally having dissolved or dispersed therein, for instance, the optical brightener, the discolouration inhibitor and the methyl vinyl ether—maleic acid copolymer, and other components if convenient. It has been found to be advantageous to maintain the carrier granules, while they are being sprayed and/or afterwards at a temperature of above 35° C., especially about 40° C. to 75° C. for a period of about ½ to 5 minutes, whereby the free flowing properties of the composition are improved.

Heat sensitive solid, granular or powdery, components are dry mixed with the carrier granules either before or after spray-on of the nonionic detergent-cationic softener mixture.

EXAMPLE I

A granular detergent composition of the following composition was prepared.

| Compositions (percent by weight) | | I |
|---|---|---|
| (b) | Ditallow dimethyl ammonium chloride | 6 |
| (b) | Dobanol 45-7 (1) | 12 |
| (a) | Sodium dodecyl benzene sulphonate | 0.5 |
| (a) | Sodium tripolyphosphate | 33 |
| (a) | Sodium silicate (2) | 4 |
| (a) | Sodium sulphate | 21 |
| (c) | Sodium perborate tetrahydrate | 12 |
| (a) | Bis(benzoxazole-2-yl)thiophene | 0.04 |
| (c) | Enzyme containing granules | 1.3 |
| (a) | Sodium ethylene diamine tetra acetate | 0.2 |
| (a) | Sodium ethylene diamine tetra-methylene phosphate (EDTMP) | 0.5 |
| — | Water and impurities etc. | to 100 |

(1) $C_{14-15}$ primary alcohols condensed with 7 molar proportions of ethylene oxide
(2) Weight ratio $SiO_2$:$Na_2O$ = 1.6:1

The composition was prepared by making spray dried granules comprising component (a) with some moisture, and spray drying the granules in a rotating drum or an inclined pan granulator with a molten mixture of components (b). These granules were then dry mixed with components (c).

This composition had textile softening as well as cleaning properties, and removed tea, wine and coffee stains better than an otherwise identical composition lacking the EDTMP component.

Similar results are obtained when the EDTMP is replaced by sodium diethylene triamine penta methylene phosphonate.

Similar performance is also obtained when the ditallow dimethyl ammonium chloride is replaced by the corresponding methylsulphate or by Varisoft 475 (Trade Mark), which is an imidazolinium-type softener.

Similar results are also obtained when the Dobanol 45-7 is replaced by coconut alcohol condensed with 6 molar proportions of ethylene oxide.

Other useful compositions are obtained when the EDTMP is replaced by nitrilotrimethylene phosphonate, ethane 1-hydroxy-1,1-diphosphonate, propane-1,2,3-triphosphonate and aminomethane diphosphonate.

EXAMPLE II

An effective textile washing and softening composition has the formula in parts percent by weight:

| | |
|---|---|
| Coconut alcohol $E_6$ | 10 |
| Ditallow dimethyl ammonium chloride | 4 |
| Tallow soap | 1 |
| Sodium tripolyphosphate | 48 |
| Sodium silicate ($SiO_2$:$Na_2O$ 2:1) | 6 |
| Sodium sulphate | 18 |
| Sodium carboxymethyl cellulose | 0.7 |
| Gantrez AN119 (Trade Name) | 0.7 |
| Polyethylene glycol (M.Wt 6000) | 1.3 |
| 1,2-bis(benzoxazole-2-yl)ethylene | 0.05 |
| EDTMP | 0.5 |
| Perfume | 0.5 |
| Moisture and impurities | Balance to 100 |

EXAMPLE III

A detergent composition with pronounced textile softening properties has the formula, in parts percent by weight:

| | |
|---|---|
| Dobanol 45-7 | 10 |
| Ditallow dimethyl ammonium chloride | 9 |
| Sodium dodecylbenzene sulphonate | 1 |
| Sodium tripolyphosphate | 33 |
| Sodium silicate | 4 |
| Sodium sulphate | 18 |
| Sodium perborate tetrahydrate | 12 |
| Sodium carboxymethyl cellulose | 1 |
| Gantrez S95 (Trade Mark) | 1 |
| Enzyme containing granules | 1 |
| Bis-(5 methyl-benzoxazole-2-yl)thiophene | 0.05 |
| Tallow alcohol $E_{25}$ | 1 |
| EDTMP | 0.5 |
| Moisture and impurities | Balance to 100 |

EXAMPLE IV

A textile softening heavy duty detergent has the following formula, in parts percent by weight:

| | |
|---|---|
| Dobanol 23-6.5 (1) | 20 |
| Ditallow dimethyl ammonium chloride | 3 |
| Sodium tripolyphosphate | 50 |
| Sodium silicate ($SiO_2$:$Na_2O$ = 1.6:1) | 4 |
| Sodium carboxy methyl cellulose | 0.7 |
| Gantrez S95 | 0.7 |
| Sodium sulphate | 13 |
| Tallow alcohol - $E_{80}$ | 1 |
| 1,2-bis(5-methyl benzoxazole-2-yl) ethylene | 0.5 |
| Perfume | 0.5 |
| EDTMP | 1.0 |

-continued

| | |
|---|---|
| Moisture and Minors | Balance to 100 |

(1) Trade Mark. $C_{12-13}$ alcohols condensed with 6.5 molar proportions of ethylene oxide.

EXAMPLE V

A granular detergent composition was prepared haveing the following formula:

| | |
|---|---|
| Ditallow dimethyl ammonium chloride | 6 |
| Dobanol 45-7 | 12 |
| Sodium dodecyl benzene sulphonate | 0.5 |
| Sodium tripolyphosphate | 33 |
| Sodium silicate ($SiO_2$:$Na_2O$ 1.6:1) | 4.2 |
| Sodium sulphate | 18 |
| Sodium perborate tetrahydrate | 12 |
| Sodium carboxymethyl cellulose | 0.7 |
| Enzyme-containing granules | 1.3 |
| Optical brightener[1] | 0.04 |
| Optical brightener[2] | 0.2 |
| Tallow alcohol $E_{80}$ | 1.0 |
| Sodium ethylenediamine tetraacetate | 0.24 |
| Sodium ethylenediamine tetra methylene phosphonate | 0.5 |
| Moisture and miscellaneous | Balance to 100 |

[1]Bis(benzoxazole-2-yl)thiophene
[2]brightener of formula:

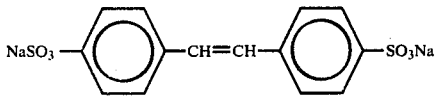

What we claim is:

1. In a process for preparing a softening and detergent composition consisting essentially of, by weight, (a) from about 3% to 30% of one or more polyethoxy nonionic surfactants having a hydrophilic-lipophilic balance in the range from about 8 to about 15 and having not more than an average of about 16 ethoxy units per molecule; (b) from about 1% to about 15% of one or more cationic textile softeners; (c) from about 10% to about 80% of one or more detergency builders selected from the group consisting of water-soluble carbonates, borates, phosphates, polyphosphates, tripolyphosphates, bicarbonates, silicates, sulfates, amino polyacetates, phytates, polycarboxylates and water-insoluble aluminosilicates; and (d) from about 0.1% to about 5% of a discoloration inhibitor which is a water-soluble polyphosphonic acid having the general formula:

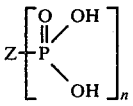

or a water soluble salt thereof, where n is at least 2 and Z is a connecting organic moiety having an effective covalency equal to n; said composition being characterized in that the weight ratio of nonionic detergent to cationic textile softener is in the range from about 10:1 to about 1:1, and further characterized in that said composition optionally contains only minor amounts anionic surfactants up to a weight ratio of anionic surfactant:cationic softener less than 1:5, which process comprises the steps of: (i) preparing spray-dried carrier granules containing discoloration inhibitor component (d) and at least part of the detergency builder component (c), (ii) preparing a fluid mixture of nonionic surfactant component (a) and cationic softener component (b), (iii) spraying said fluid mixture on to a moving bed of said carrier granules, the improvement which comprises:

including in the spray dried carrier granules (i) from about 0.1% to about 5% of an anionic surfactant selected from alkali metal $C_9$–$C_{16}$ alkyl benzene sulphonates, and $C_{12}$–$C_{20}$ alkali metal soaps, and maintaining the weight ratio of anionic surfactant to cationic softener (b) less than 1:5, whereby an appropriate product density is secured;

melting components (a) and (b) together and adding to the resulting molten mixture from about 0.3% to about 5.0%, by weight of the composition, of a second discoloration inhibitor selected from the group consisting of $C_{10}$–$C_{20}$ primary alcohol ethoxylates condensed with from about 17 to about 100 molar proportions of ethylene oxide, polyethylene glycols of molecular weight from about 1000 to about 3000, and mixtures thereof, and spraying the molten mixture on a moving bed of the carrier granules which are maintained at a temperature from about 40° C. to about 75° C. during and for about 0.5 to about 5 minutes after said spraying operation, whereby a free-flowing composition is secured.

* * * * *